United States Patent [19]

Wright

[11] 4,019,908

[45] Apr. 26, 1977

[54] SILVER HALIDE PHOTOGRAPHIC MATERIAL

[75] Inventor: Peter John Wright, Ilford, England

[73] Assignee: Ilford Limited, England

[22] Filed: Nov. 6, 1973

[21] Appl. No.: 413,202

[30] Foreign Application Priority Data

Nov. 22, 1972 United Kingdom ..... 53869/72

[52] U.S. Cl. ..... 96/114; 96/67; 96/87 R; 96/115 P

[51] Int. Cl.[2] ..... G03C 1/72; G03C 1/68

[58] Field of Search ..... 96/114, 67, 87 R, 115 P; 117/161 OC, 161 OB; 260/79.3 M, 23 H, 27 R, 27 EV, 28.5 AV; 204/159.22

[56] References Cited

UNITED STATES PATENTS

| | | | |
|---|---|---|---|
| 2,791,504 | 5/1957 | Plambeck | 96/115 P |
| 3,536,491 | 10/1970 | Rees et al. | 96/87 |
| 3,554,987 | 1/1971 | Smith | 260/79.3 |
| 3,576,628 | 4/1971 | Beavers | 96/114 |
| 3,592,655 | 7/1971 | Dykstra | 96/114 |
| 3,847,609 | 12/1974 | Breslow et al. | 96/115 P X |
| 3,904,418 | 9/1975 | Mowrey | 96/87 R X |
| 3,904,499 | 9/1975 | Morgan | 96/115 P X |
| 3,929,482 | 12/1975 | Ponticello | 96/114 |

*Primary Examiner*—Edward C. Kimlin
*Attorney, Agent, or Firm*—Wenderoth, Lind & Ponack

[57] ABSTRACT

This invention relates to a silver halide photographic material at least one gelatin layer of which contains a copolymer derived from I vinyl acetate and another monomer
II an allyl or methallyl acyl acetate and optionally
III a sulphonate with an allyl or methallyl group.

The material can be hardened to a greater degree than the usual materials.

7 Claims, No Drawings

SILVER HALIDE PHOTOGRAPHIC MATERIAL

Whilst in practice the colloid medium of a silver halide emulsion has almost always consisted wholly of gelatin, numerous proposals to replace the gelatin wholly or in part with other colloids have been made, In particular, it has been proposed in more recent patent literature to replace part of the gelatin by a water insoluble synthetic polymer which is included in the emulsion during preparation in the form of a latex and numerous advantages have been claimed for such additions.

Recently due to the increased use of automatic processing and the use of processing solutions at higher temperatures it is becoming important that the layers of photographic silver halide materials should be hardened to a greater extent than has been the practice hitherto. A number of gelatin synthetic copolymer mixtures which have been used or which have been proposed to be used can be hardened using the usual gelatin hardeners under the usual hardening conditions to produce layers which have approximately the same degree of hardness as gelatin layers. However we have now discovered a class of synthetic copolymers which when mixed with gelatin to form a layer in photographic material can be hardened to a greater degree than a gelatin layer using the usual gelatin hardeners under the usual hardening conditions.

According to the present invention there is provided a silver halide photographic element having coated on a photobase at least one colloid layer which comprises both gelatin and a film-forming copolymer derived from:

I. A monomer mixture comprising vinyl acetate with at least one other monomer copolymerisable therewith, the said mixture of monomers being selected so that the glass transition temperature of the copolymer of vinyl acetate and the other monomer or monomers is below 20° C, II. an allyl or methallyl monomer of the formula

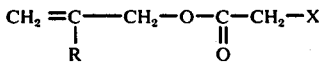

(1)

where R is a hydrogen atom or a methyl group and X is an aliphatic acyl group or a cyano group.

Component I above is preferably vinyl acetate together with one monomer which is copolymerisable therewith to form a copolymer having a glass transition temperature of below 0° C and thus acts as a softening agent for the vinyl acetate.

Examples of monomers which may be used as softening agents for the vinyl acetate are alkyl acrylates or methacrylates wherein the alkyl group comprises at least four carbon atoms, e.g. hexyl acrylate. Other useful monomers for this purpose are alkyl esters of fumaric or maleic acid wherein each alkyl group comprises at least four carbon atoms. Other monomers useful for this purpose are di-(polypropyleneoxy) itaconate, 4-dodecyl styrene, 4-nonyl styrene and vinyl isobutyl ether.

Component II comprises a reactive methylene group and it is the presence of units of this component in the final copolymer which makes it comparatively easy to harden the photographic emulsion.

Examples of aliphatic acyl groups are butyryl and propionyl. However the preferred acyl group is acetyl.

By "colloid layer" is meant a layer in a photographic element composed of a colloid. Examples of such layers are silver halide emulsion layers and is this case the colloid acts as a binder for the silver halide cyrstals. Other colloid layers which may be present are interlayers which serve to separate the silver halide emulsion layers in multi-layer material, for example colour photographic material. Such interlayers often contain addenda such as acutance dyes. However the greatest use of the colloid layer of the present invention is a silver halide emulsion layer, the gelatin and copolymer mixture acting at the binder for the silver halide crystals.

It is often required to include in gelatino silver halide emulsions salts of divalent metals such as cadmium or lead and it is known that such salts often have a powerful sedimenting action on synthetic polymer latices even in the presence of the preferred class of surfactants. If it is required to include salts of divalent metals in the photographic emulsion layer of the present invention it is preferred that the copolymer comprises also a component III which is derived from a monomer which comprises an allyl or methallyl radical linked to a sulphonic acid or sulphonate group.

The monomer from which component III is derived is preferably a monomer of the formula

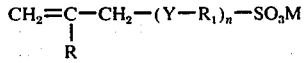

(2)

where R is a hydrogen atom or a methyl group, Y is an oxygen atom or a sulphur atom, $n$ is 0 or 1, $R_1$ is an alkyl or hydroxy alkyl group and M is a hydrogen atom, an ammonium or substituted ammonium group or a metal cation.

Whilst the relative proportions of the monomers which go to make up the copolymer may be varied widely, it is of course essential since the product must be a latex when it is introduced into the emulsion, that the copolymer should have a relatively low solubility in water. Further it is necessary that the glass transition temperature of component I should be below 20° C so that the copolymer derived from components I and II when present in the photographic layer is not particulate in nature.

The ratio of gelatin to film-forming copolmyer in the colloid layer may be from 90 gelatin to 10 of copolymer by weight to 40 gelatin to 60 copolymer by weight.

Generally if components I and II only are present the proportion of monomer II should not exceed 20% by weight of the total monomer mixture and should not be below 1% of the total monomer mixture. If components I, II and III are present the total proportion of components II and III together should be within the range of from 5:1 of II to III to 1:1 of II to III. At least 1% of the total monomers by weight must be component II. With regard to component I which comprises vinyl acetate and at least one other monomer as a softening agent preferably the softening agent or agents comprises 10–30% by weight of component I.

Synthetic polymer latices are generally prepared by polymerising in aqueous medium in the presence of a surfactant. Alkyl aryl polyether sulphates are known to be particularly useful surfactants for the purpose, though numerous other types may be used.

The polymer latices for use in the present invention may be prepared by polymerisation of the mixed monomers by a free-radical generating agency in a aqueous medium in the presence of a surfactant.

The following preparations serve to illustrate the preparation of the latices used in the Examples which follows.

Preparation of Latex A.

Four components were used.

| | |
|---|---|
| (a) | A solution containing, in 425 ml distilled water, 1.9 g of an alkyl aryl polyglycol sulphate and 1.0 g potassium persulphate (as polymerisation catalyst). |
| (b) | 74.4 g Vinyl acetate.<br>31.8 g 2-Ethyl hexyl acrylate.<br>12.5 g Allyl acetoacetate. |
| (c) | A solution containing, in 35 ml distilled water, 6.3 g sodium 2-allyloxyethane-1-sulphonate and 1.9 g of an alkyl aryl polyglycol sulphate (as a 30 % solution). |
| (d) | 1.0 g potassium persulphate in 40 ml of distilled water (as polymerisation catalyst). |

Solution (a) was placed in a flask equipped with stirrer and gas inlet and thoroughly purged with nitrogen. The temperature was raised to 85° C and (b) and (c) introduced simultaneously over a period of about two hours, with continual stirring. Peristaltic pumps were used for this purpose. Solution (d) was added in four equal portions at half-hourly intervals.

The mixture was finally stirred for one hour more at 90° C and then steam distilled to remove small amounts of unreacted vinyl acetate monomer. The pH of the latex was adjusted to 6 with sodium hydroxide.

PREPARATION OF LATEX B

A latex was prepared by copolymerising by continuous addition of monomers in a similar way to that described for latex A.

| | |
|---|---|
| Vinyl acetate | 60 parts by weight. |
| Bis-(2-ethylhexyl)-fumarate | 15 parts by weight. |
| Allyl acetoacetate | 20 parts by weight. |
| Sodium-2-allyloxyethane-1-sulphonate | 5 parts by weight. |

Copolymerization was carried out in the presence of 3.0% by weight based on the total monomers of an alkyl aryl polyglycol sulphate as a surfactant. The conditions were so adjusted to provide a latex containing 22% by weight of the copolymer and having a pH of 6.0.

PREPARATION OF LATEX C

| | |
|---|---|
| Vinyl acetate | 60 parts by weight. |
| Dibutyl maleate | 15 parts by weight. |
| Allyl acetoacetate | 20 parts by weight. |
| Sodium 2-allyloxy-ethane-1-sulphonate | 5 parts by weight. |

These monomers were copolymerised as described for latex A in the presence of 3% by weight based on total monomers of an alkyl aryl polyglycol sulphate as surfactant and potassium persulphate as polymerisation catalyst.

PREPARTION OF LATEX D

| | |
|---|---|
| Allyl cyanoacetate | 20 parts by weight. |
| Vinyl acetate | 60 parts by weight. |
| Dibutyl maleate | 15 parts by weight. |
| Sodium allyl oxypropanol | 5 parts by weight. |

These monomers were copolymerised as described for latex A in the presence of 3% by weight based on total monomers of an alkyl aryl polyglycol sulphate as surfactant.

PREPARATION OF LATEX E

| | |
|---|---|
| Allyl acetoacetate | 20 parts by weight. |
| Vinyl acetate | 60 parts by weight. |
| 2-Ethyl hexyl acrylate | 15 parts by weight. |
| Sodium 2-allyloxyethane-1-sulphonate | 5 parts by weight. |

These monomers were copolymerised as described for Latex A, in the presence of 4% by weight based on total monomers of the sodium salt an alkyl aryl polyether phosphate as surfactant.

The latices for use in the present invention are preferably mixed with an aqueous gelatino solution (for example a silver halide emulsion), which contains less than the usual amount of gelatin and the aqueous mixture is coated on to a photographic support together with a hardening agent and the usual coating aids. The coated layer is then dried to yield a hardened colloid, for example, a hardened silver halide emulsion layer.

Any of the usual gelatin hardening agents may be used, e.g., formaldehyde. The usual amount of hardening agent is from 0.5 to 2.0% by weight of the weight of gelatin present in the aqueous mixture before coating.

The latices for use in the present invention, when mixed with gelatin and a gelatin hardening agent, provide a hardened colloid layer greater in hardness than a colloid layer which is composed entirely of gelatin. This is to be compared with a layer which contains gelatin in admixture with a polymer latex which does not contain units of a monomer of formula (1). Such layers can not be hardened so satisfactorily as layers composed of the colloid layer used in the present invention. This is shown in the Examples which follow.

In the Examples the dried photographic emulsion layers were tested by a comparative scratch resistance method where a loaded stylus is drawn across the swollen layers which are immersed in a liquid. The minimum weight required to scratch the surface of the layer is determined.

EXAMPLE I

A conventional gelatin chlorobromide emulsion was prepared containing 60% by weight of the normal amount of gelatin. To this was added sufficient latex A to give a binder consistency of 40 parts of polymer to 60 parts of gelatin. The resulting emulsion was coated onto film base and found to coat without difficulty. To serve as control samples identical coatings were made with an emulsion containing the full amount of gelatin and with an emulsion containing 40 parts of an interpolymer prepared from 67 parts vinyl acetate, 28 parts 2-ethyl hexyl acrylate and 5 parts of sodium allyl oxyethyl sulphonate (X) (i.e., a copolymer outside the scope of the present invention). To each emulsion sample was added 0.75% based on the weight of the gelatin present, of formaldehyde as hardener. The melting points of the coatings in water were determined after seven days standing under ambient conditions, and the comparative hardness values were also determined in a metal-hydroquinone developer at 20° C.

| | MP° C | Scratch Hardener (g) |
|---|---|---|
| Gelatin alone | 50° | 720 |
| Gelatin + latex A | 95° | 850 |
| Gelatin + latex X | 54° | 710 |

The coating containing latex A also exhibited good dimensional stability. Similar results were obtained when latices B, C, D and E were included in the emulsion in place of part of the gelatin.

EXAMPLE II

In order to illustrate the copolymers used in the present invention in an interlayer in photographic material, latex E, 3.5 parts by weight, as hereinbefore prepared, was mixed with gelatin, 6.5 parts by weight, together with 0.25% by weight of formaldehyde and coated on strips of film material at a coating weight of 50 mg per decimetre of the film material. For comparison an equivalent weight of gelatin together with 0.25% by weight of formaldehyde was coated on to other strips of film material. A third coating comprising 3.5 parts by weight of latex X used in Example I, 6.5 parts by weight of gelatin and 0.25% by weight of formaldehyde was coated on to a third set of film strips.

The comparative hardness values of the three sets of coated strips were tested in plain water; their comparative hardness values were determined after 1 day, after 7 days storage, after 14 days storage and after one 1 day incubation at a temperature of 60° C at 60% RH. The following results were obtained.

| | Tests | | | |
|---|---|---|---|---|
| Coating | 1 Day | 7 Days | 14 Days | 1 Day incubation |
| Gelatin alone | 314 | 440 | 480 | 1380 |
| Gelatin + latex E | 360 | 500 | 560 | 1800 |
| Gelatin + latex X | 210 | 340 | 360 | 520 |

These test show that under normal storage conditions the coated layer containing latex E hardened a little better than gelatin alone but when incubated it hardened to a greater extent. However the coated layer which contained the latex X hardened less well than gelatin when stored normally, but exhibited poor hardening properties when incubated, compared with the other two coated layers.

What we claim is:

1. A silver halide photographic element comprising a photobase having coated thereon at least one colloid layer which comprises gelatin and a film forming copolymer derived from:

I. a monomer mixture comprising vinyl acetate and at least one other monomer copolymerisable therewith, said mixture of monomers being selected such that the glass transition temperature of the copolymer of vinyl acetate and the other monomer or monomers is below 20° C, and II. an allyl or methallyl monomer of the formula

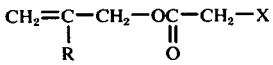

where R is a hydrogen atom or a methyl group and X is an aliphatic acyl group or a cyano group, the proportion of component II being 1–20% by weight based on the total weight of components I and II.

2. A silver halide photographic element according to claim 1 wherein component I comprises vinyl acetate together with one monomer which is copolymerisable therewith to form a copolymer having a glass transition temperature below 0° C.

3. A silver halide photographic element according to claim 2 wherein the monomer which is copolymerisable with vinyl acetate is an alkyl acrylate or methacrylate wherein the alkyl group contains at least four carbon atoms.

4. A silver halide photographic element according to claim 3 wherein the copolymerisable monomer is hexyl acrylate.

5. A silver halide photographic element according to claim 1 wherein the monomer which is copolymerisable with vinyl acetate is an alkyl ester of fumaric or maleic acid wherein each alkyl group contains at least four carbon atoms.

6. A silver halide photographic element according to claim 1 wherein the monomer which is copolymerisable with vinyl acetate is di(-polypropyleneoxy) itaconate, 4-dodecyl styrene, 4-nonyl styrene or vinyl isobutyl ether.

7. A silver halide photographic element according to claim 1 which further comprises a component III which is derived from a monomer which comprises an allyl or methallyl radical linked to a sulphonic acid or sulphonate group, the proportion of component II:component III being from 5:1 to 1:1.

* * * * *